US011268176B2

(12) United States Patent
Zhao et al.

(10) Patent No.: US 11,268,176 B2
(45) **Date of Patent: *Mar. 8, 2022**

(54) HIGH STRENGTH STEEL PLATE AND MANUFACTURING METHOD THEREOF

(71) Applicant: BAOSHAN IRON & STEEL CO., LTD., Shanghai (CN)

(72) Inventors: Sixin Zhao, Shanghai (CN); Liandeng Yao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/762,216

(22) PCT Filed: Dec. 24, 2013

(86) PCT No.: PCT/CN2013/090268

§ 371 (c)(1),
(2) Date: Jul. 21, 2015

(87) PCT Pub. No.: WO2014/114158

PCT Pub. Date: Jul. 31, 2014

(65) Prior Publication Data

US 2015/0361531 A1 Dec. 17, 2015

(30) Foreign Application Priority Data

Jan. 22, 2013 (CN) ..... 201310022008.3

(51) Int. Cl.
*C22C 38/38* (2006.01)
*C22C 38/00* (2006.01)
(Continued)

(52) U.S. Cl.
CPC ..... *C22C 38/38* (2013.01); *C21D 6/002* (2013.01); *C21D 6/005* (2013.01); *C21D 6/008* (2013.01);
(Continued)

(58) Field of Classification Search
CPC ..... C22C 38/02; C22C 38/04
(Continued)

(56) References Cited

U.S. PATENT DOCUMENTS 6,228,183 B1 * 5/2001 Bangaru ..... C22C 38/04 148/320
2009/0314395 A1 * 12/2009 Nonaka ..... C22C 38/04 148/624
2010/0032062 A1 2/2010 Yao et al.

FOREIGN PATENT DOCUMENTS

CN 1840724 A 10/2006
CN 101418416 A 4/2009
(Continued)

OTHER PUBLICATIONS

English language machine translation of CN102618793 to Zhao et al. Generated Jun. 7, 2017.*
(Continued)

*Primary Examiner* — Brian D Walck
(74) *Attorney, Agent, or Firm* — Quarles & Brady LLP

(57) ABSTRACT

The invention discloses a high-strength steel plate, comprising the following chemical elements in mass percentages: C: 0.070-0.115%, Si: 0.20-0.50%, Mn: 1.80-2.30%, Cr: 0-0.35%, Mo: 0.10-0.40%, Nb: 0.03-0.06%, V: 0.03-0.06%, Ti: 0.002-0.04%, Al: 0.01-0.08%, B. 0.0006-0.0020%, N≤0.0060%, O≤0.0040% Ca: 0-0.0045%, and the balance of Fe and unavoidable impurities. The invention further discloses a process of manufacturing said high-strength steel plate.

7 Claims, 1 Drawing Sheet

(51) Int. Cl.

| | |
|---|---|
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/14*** | (2006.01) |
| ***C22C 38/12*** | (2006.01) |
| ***C22C 38/04*** | (2006.01) |
| ***C21D 8/04*** | (2006.01) |
| ***C21D 6/00*** | (2006.01) |
| ***C21D 8/02*** | (2006.01) |
| ***C21D 9/46*** | (2006.01) |

(52) U.S. Cl.
CPC ..... *C21D 8/021* (2013.01); *C21D 8/0263* (2013.01); *C21D 8/0426* (2013.01); *C21D 8/0463* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C22C 38/32* (2013.01)

(58) Field of Classification Search
USPC ..... 148/330, 337
See application file for complete search history.

(56) References Cited

FOREIGN PATENT DOCUMENTS

| | | | | |
|---|---|---|---|---|
| CN | 101906594 | A | 12/2010 | |
| CN | 102260283 | A | 11/2011 | |
| CN | 102618793 | A | 8/2012 | |
| CN | 102618800 | A | 8/2012 | |
| CN | 102787272 | A | 11/2012 | |
| CN | 103060690 | A | 4/2013 | |
| EP | 2484791 | A1 | 8/2012 | |
| EP | 2524972 | A1 * | 11/2012 | ..... C21D 8/0436 |
| JP | S63121618 | A | 5/1988 | |
| JP | H02170943 | A | 7/1990 | |
| JP | H06145787 | A | 5/1994 | |
| JP | H0913145 | A | 1/1997 | |
| JP | 2008169440 | A | 7/2008 | |
| JP | 2009242841 | A | 10/2009 | |
| JP | 2010229528 | A | 10/2010 | |
| JP | 2012021214 | A | 2/2012 | |
| KR | 20010022330 | A | 3/2001 | |
| RU | 2210603 | C2 | 8/2003 | |
| RU | 2215813 | C2 | 11/2003 | |
| WO | 9905335 | A1 | 2/1999 | |
| WO | 9905336 | A1 | 2/1999 | |
| WO | 03006699 | A1 | 1/2003 | |
| WO | 2011148755 | A1 | 12/2011 | |
| WO | 2012161248 | A1 | 11/2012 | |

OTHER PUBLICATIONS

Supplementary European Search Report issued in corresponding European Patent Application No. 13 87 2709, dated Jul. 29, 2016, 9 pages.

First Chinese Office Action, including Search Report, issued in corresponding Chinese Patent Application No. 201310022008.3, dated Sep. 28, 2014, 10 pages.

PCT International Search Report, PCT/CN2013/090268, dated Mar. 27, 2014, 8 pages.

Japan Patent Office, Notification of Reasons for Refusal, Application No. 2015-552984, dated Nov. 28, 2017.

Australian Government—IP Australia, Examination Report No. 1, Application No. 2013375523, dated Jun. 20, 2017, 3 pages.

Russian Federal Service for Intellectual Property, Issues, Arguments, Comments, Suggestions, Application No. RU 2015136605, dated Jul. 6, 2017, 6 pages.

European Patent Office, Communication pursuant to Article 94(3) EPC, EP Application No. 13 872 709.4, dated Feb. 22, 2018, 6 pages.

Questions, Arguments, Remarks, Suggestions issued in corresponding Russian Application No. 2015136605/02(056032) issued Oct. 8, 2018, 10 pages.

Intellectual Property India, Examination Report, Application No. 2016/MUMNP/2015, dated Oct. 18, 2019, 9 pages.

Korean Intellectual Property Office, Notification of Reason for Refusal, Application No. 10-2015-7022770, dated Feb. 3, 2020, 12 pages.

* cited by examiner

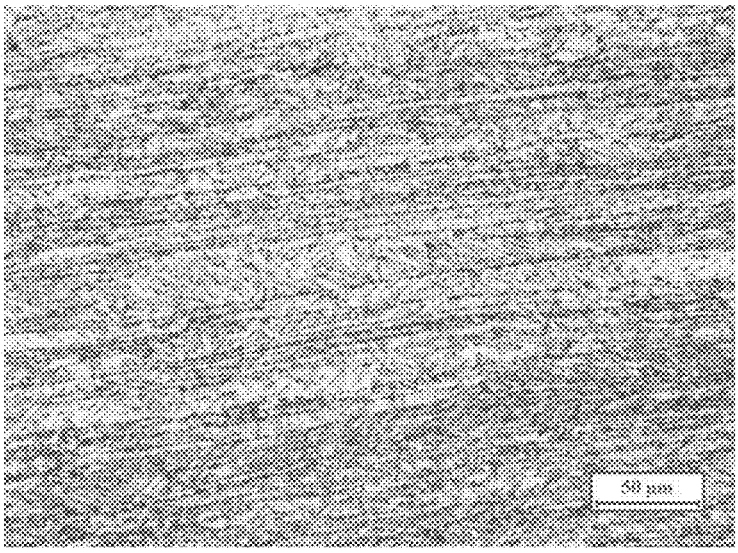
50 μm

HIGH STRENGTH STEEL PLATE AND MANUFACTURING METHOD THEREOF

CROSS-REFERENCE TO RELATED APPLICATIONS

This application represents the national stage entry of PCT International Application No. PCT/CN2013/090268 filed Dec. 24, 2013, which claims priority of Chinese Patent Application No. 201310022008.3 filed Jan. 22, 2013, the disclosures of which are incorporated by reference here in their entirety for all purposes.

TECHNICAL FIELD

The invention relates to the metallurgical field, particularly to a steel plate and a process of manufacturing the same.

BACKGROUND ART

Generally, high-strength and toughness steel plates are widely used for manufacturing structural members used in engineering machinery, mining machinery and harbor machinery. The improvement of social productivity entails higher efficiency, lower energy consumption and longer service life of mechanical equipments. The high strength and toughness attribute of a steel plate for mechanical structural members is a critical means for strengthening and lightening mechanical equipments. For a high-strength steel plate used for mechanical structures, the contribution of various factors to the strength may be represented by the following formula:

$$\sigma=\sigma_f+\sigma_p+\sigma_{sl}+\sigma_d$$

wherein $\sigma_f$ stands for grain refinement strengthening, $\sigma_p$ stands for precipitation strengthening, $\sigma_{sl}$ stands for solid solution strengthening, and $\sigma_d$ stands for dislocation strengthening. Grain refinement strengthening generally refers to increase of strength by refinement of ferrite grains. In recent years, refinement of bainite sub-lamellae and lamella size is also used as a means for refinement strengthening. Precipitation strengthening involves a suitable heat treatment process in which strong carbide forming elements such as Cr, Mo and V form fine and dispersed carbonitrides with C or N. The carbonitrides precipitate and impede the motion of dislocations and grain boundaries, so as to increase the strength of the steel plate. Solid solution strengthening is classified into two cases, in one of which replacement atoms such as Si, Mn, Ni and other alloy elements are solid-dissolved in the FCC structure and replace Fe atom, such that dislocation motion is baffled and thus the strength is increased; and in the other of which interstitial atoms such as C, N, etc. are solid-dissolved in the interstices between the tetrahedrons or octahedrons of a lattice, such that the lattice constant is changed and thus solid solution strengthening is fulfilled. The solid solution strengthening via interstitial atoms is more effective than the solid solution strengthening via replacement atoms, but will lead to decreased low-temperature impact work. Dislocation strengthening is effected by introducing a large quantity of dislocations into the grains, such that the starting energy of dislocations and the energy dissipated in motion are increased, and thus the strength is increased. In order to acquire a high-strength steel plate having good comprehensive mechanical performances and application performances, a combined effect of the above four strengthening means is generally adopted to increase the strength of the steel plate and ensure the low-temperature impact resistance as well as the weldability of the steel plate.

A high-strength and toughness steel plate is generally produced by a process that comprises the combination of conditioning (quenching+tempering) and TMCP (Thermal-mechanical Controlling Process). Generally, a steel plate having a yield strength of 890 MPa or higher produced by the quenching+tempering process has a relatively high carbon content (>0.14%) because of the generation of a tempered martensite or tempered sorbite structure, and the carbon equivalent value CEV and the welding crack sensitivity index Pcm are also relatively high. According to the TMCP technology, particular chemical components are adopted, and deformation occurs in a given range of temperature. After rolling to a given thickness, phase transition is effected in a particular temperature zone by controlling the cooling rate and the final cooling temperature, so as to provide a structure having good properties. At the same time, a combination of the TMCP technology and optimized alloy components is used, wherein a comprehensive use of grain refinement strengthening, dislocation strengthening and other strengthening means provides a steel plate having good strength-toughness match and a low carbon equivalent value.

Weldability is one of the important application performances of steel used for mechanical structures. As a measure for enhancing weldability, the carbon equivalent value CEV of the alloy composition of a steel plate and the welding crack sensitivity index Pcm value are decreased. The carbon equivalent value of a steel plate may be calculated according to the following formula:

$$CEV=C+Mn/6+(Cr+Mo+V)/5+(Ni+Cu)/15 \quad (1)$$

The welding crack sensitivity index Pcm value of a steel plate may be determined according to the following formula:

$$Pcm=C+Si/30+Ni/60+(Mn+Cr+Cu)/20+Mo/15+V/10+5B \quad (2)$$

As specified by P.R.C Ferrous Metallurgical Industry Standard YB/T 4137-2005, for the steel type which has a yield strength of 800 MPa and a code Q800CF, the Pcm value thereof shall be less than 0.28%. According to European Standard 10025-6:2004 and Chinese National Standard GB/T16270: 2009, the carbon equivalent value CEV of a steel plate having a yield strength of 890 MPa is limited to ≤0.72%.

When the carbon equivalent value and the welding crack sensitivity index of a steel plate are relatively high, additional amounts of alloying elements may be added, and a steel plate having good mechanical properties may be obtained easily. However, this may degrade the weldability of the steel plate. As a result, not only hot cracks tend to occur during welding, but also cold cracks form easily during storage after welding. Enterprises hope to use low contents of alloying elements to provide a steel plate for mechanical structures with a relatively low carbon equivalent value and a relatively low welding crack sensitivity index, as well as good mechanical properties.

The patent document titled "ULTRA-HIGH STRENGTH, WELDABLE STEELS WITH EXCELLENT ULTRA-LOW TEMPERATURE TOUGHNESS" (publication number: WO1999005335; publication date: Feb. 4, 1999) discloses a low alloying elements, high strength steel produced by a TMCP process based on two temperature stages, which has a tensile strength of 930 MPa, an impact work at −20° C. of 120 J, and a chemical composition (wt. %) of: C: 0.05-0.10%, Mn: 1.7-2.1%, Ni: 0.2-1.0%, Mo: 0.25-0.6%, Nb: 0.01-0.10%, Ti: 0.005-0.03%, P≤0.015%, S≤0.003%. In this patent application for invention, Ni, which is used as an alloying element, has a relatively high content of 0.2-1.0%. However, the carbon equivalent value and the welding crack sensitivity index are not specified.

The Chinese patent document titled "900 MPa LEVEL YIELD STRENGTH QUENCHED AND TEMPERED STEEL PLATE AND MANUFACTURING METHOD THEREOF" (publication number: CN101906594A; publication date: Dec. 8, 2010) relates to a high yield strength quenched and tempered steel plate and a manufacturing method thereof, wherein the chemical composition (wt. %) of the steel plate is as follows: C: 0.15-0.25%, Si: 0.15-0.35%, Mn: 0.75-1.60%, P: ≤0.020%, S: ≤0.020%, Ni: 0.08-0.30%, Cu: 0.20-0.60%, Cr: 0.30-1.00%, Mo: 0.10-0.30%, Al: 0.015-0.045%, B: 0.001-0.003%, and the balance of Fe and unavailable impurities. The steel plate obtained in this patent has an Akv at −40° C. of ≥21 J (vertical) and a carbon equivalent value of less than 0.60%. In this patent application for invention, precious alloying elements such as Ni, Cu and the like exist.

SUMMARY

The object of the invention is to provide a high-strength steel plate which has high strength, toughness, good weldability, and can meet the dual requirements of the mechanical equipment industry that the steel plate should have high strength/low toughness and superior weldability.

In order to achieve the above object of the invention, there is provided a high-strength steel plate, comprising the following chemical elements in mass percentages:

C: 0.070-0.115%,
Si: 0.20-0.50%,
Mn: 1.80-2.30%,
Cr: 0-0.35%,
Mo: 0.10-0.40%,
Nb: 0.03-0.06%,
V: 0.03-0.06%,
Ti: 0.002-0.04%,
Al: 0.01-0.08%,
B: 0.0006-0.0020%,
N≤0.0060%,
O≤0.0040%,
Ca: 0-0.0045%, and
the balance of Fe and unavoidable impurities.

The microstructures of the high-strength steel plate of the invention consists of ultra-fine bainite lath and martensite.

In the high-strength steel plate of the invention, the carbon equivalent value CEV≤0.56%, wherein the carbon equivalent value CEV=C+Mn/6+(Cr+Mo+V)/5+(Ni+Cu)/15.

Weldability is one of the important application performances of steel used for mechanical structures, and the measures for enhancing weldability include decreasing the carbon equivalent value CEV of the alloy composition of a steel plate. The carbon equivalent value CEV of the alloy composition needs to be minimized to impart the steel plate with good weldability.

In addition, the weldability of the steel plate can also be improved correspondingly by controlling the welding crack sensitivity index Pcm in a low range, wherein Pcm=C+Si/30+(Mn+Cr+Cu)/20+Ni/60+Mo/15+V/10+5B. Therefore, furthermore, the welding crack sensitivity index Pcm is ≤0.27% in this technical solution.

The principle for designing the various chemical elements in the high-strength steel plate according to the invention will be described as follows:

C: Addition of alloying elements in steel may increase the strength of a steel plate, but the carbon equivalent value and the welding crack sensitivity index will be increased too, which will deteriorate the weldability. If the carbon content is rather low, a low-strength ferrite structure will be formed in the steel plate during the TMCP process, and the yield strength and the tensile strength of the steel plate will be decreased. Based on comprehensive consideration in view of the requirement of a steel plate for strength and toughness, the C content should be controlled at 0.070-0.115% in the invention.

Si: Si does not form a carbide in steel. Instead, it exists in a Fcc or Bcc lattice in the form of solid solution, and improves the strength of the steel plate by means of solid solution strengthening. Due to the small solubility of Si in cementite, a mixed structure of residual austenite and martensite will be formed when the Si content increases to a certain degree. On the other hand, the increase of the Si content not only increases the welding crack sensitivity index of the steel plate, but also increases the propensity to hot cracking of the steel plate. With solid solution strengthening and the influence on weldability taken into account comprehensively, the Si content is controlled at 0.20-0.50% in the invention.

Mn: Mn is a weak carbide forming element that generally exists in a steel plate in the form of solid solution. For a steel plate produced by a TMCP process, Mn mainly functions to inhibit diffusivity, control interface motion, refine ferrite or bainite lath, and improve the mechanical properties of the steel plate by grain refinement strengthening and solid solution strengthening. If the Mn content is unduly high, the propensity for forming cracks in the steel plate slab will be increased, and cracks will form on the slab easily. In order to form refined bainite structure in the steel plate so as to impart good strength and toughness to the steel plate, the addition content of Mn according to the invention needs to be designed to be 1.80-2.30%.

Cr: Cr may increase the hardenability of a steel plate, such that a structure having high hardness and strength is formed in the steel plate. Increase of the Cr content has no obvious influence on the strength of a steel plate having a yield strength of 690 MPa or more. However, an unduly high content of Cr may increase the carbon equivalent value of the steel plate. Therefore, the Cr content in the invention is controlled to be not more than 0.35%.

Mo: Mo is a strong carbide forming element, and may form MC type carbides with C. In a TMCP process, Mo mainly functions to inhibit diffusional phase transition and refine the bainite structure. In the course of tempering, Mo and C form fine carbides which have the effect of precipitation strengthening, so that the tempering stability of the steel plate is increased, and the tempering platform is expanded. However, an unduly high content of Mo will increase the cost of the steel plate, make the steel plate less competitive, and increase the carbon equivalent value such that the weldability of the steel plate will be degraded. Therefore, the Mo content in the invention is controlled at 0.10-0.40%.

Nb: In the steel produced by a TMCP process, Nb mainly has the following functions: after austenization in a heating furnace, Nb solid-dissolved in the austenite acts to inhibit the motion of the recrystallization grain boundary, and increase the recrystallization temperature, such that a lot of dislocations are accumulated when the steel plate is rolled at low temperatures, and the final object of refining grains is achieved. During tempering, Nb element will be combined with C and N to form MC type carbonitrides. However, an unduly high Nb content will lead to formation of coarse carbonitrides in the steel which will affect the mechanical properties of the steel plate. Therefore, in order to control the microstructure and mechanical properties of the steel plate, the content of Nb added in the invention is controlled at 0.03-0.06%.

V: V forms MC type carbides with C and N in steel, which may increase the yield strength of the steel plate during tempering. As the V content increases, coarse carbides are formed in the zone affected by welding heat when the steel plate is welded, and thus the low-temperature impact toughness of the heat affected zone is decreased. Therefore, the content of V added in the invention is 0.03-0.06%, so as to ensure that the steel plate has a relatively high yield strength after tempering.

Ti: Ti may combine with N, O and C to form compounds at different temperatures. TiN formed in steel melt may refine austenite grains. Residual Ti in austenite may react with C to form TiC, and refined TiC is favorable for the low-temperature impact toughness of a steel plate. However, an unduly high Ti content will result in formation of coarse square TiN which will become cracking points of microcracks, lowering the low-temperature impact toughness and fatigue property of the steel plate. With the effects of Ti element in steel taken into account comprehensively, the Ti content in the invention is controlled at 0.002-0.04%.

Al: Al is added into steel as a deoxidant. Al combines with O and N in steel melt to form oxides and nitrides. During solidification of the steel melt, the oxides and nitrides of Al inhibit the motion of grain boundaries and act to refine austenite grains. If the Al content is unduly high, coarse oxides or nitrides will form in the steel plate and thus decreasing the low-temperature impact toughness of the steel plate. For the purpose of refining grains, improving the toughness of the steel plate, and guaranteeing its weldability, the Al content is designed to be 0.01-0.08% in the invention.

B: B is solid-dissolved in steel as interstitial atoms which may decrease the grain boundary energy, such that a new phase will not nucleate easily at the grain boundary. As a result, a low-temperature structure is formed in the steel plate during cooling, and the strength of the steel plate is increased. However, the increase of the B content will decrease the grain boundary energy remarkably, such that the cracking tendency of the steel plate and the welding crack sensitivity index Pcm will be increased. Therefore, B is added at an amount of 0.0006-0.0020% according to the invention.

N: The alloying elements in steel such as Nb, Ti, V and the like form nitrides or carbonitrides with N and C in the steel. In the austenization of the steel plate under heating, a portion of the nitrides are dissolved, and the undissolved nitrides may obstruct the grain boundary motion of the austenite, such that the effect of refining austenite grains can be achieved. If the content of N element is too high, it will form coarse TiN with Ti and exacerbate the mechanical properties of the steel plate. N atoms will gather at the defects in the steel, hence pinholes and looseness will be formed. Therefore, the N content in the invention is controlled to be not more than 0.0060%.

O: Alloying elements Al, Si and Ti in steel form oxides with O. During austenization of a steel plate under heating, the oxides of Al have the effect of inhibiting austenite from growing large and thus refining the grains. However, a steel plate comprising a large amount of O has a propensity to hot cracking during welding. Therefore, the O content in the invention is controlled to be not more than 0.0040%.

Ca: Ca is incorporated into steel to form CaS by reacting with S element and has the function of spheroidizing sulfides, so as to improve the low temperature impact toughness of a steel plate. The Ca content in the invention is controlled to be not more than 0.0045%.

Correspondingly, the invention further provides a process of manufacturing the high-strength steel plate, comprising the following steps in sequence: smelting, casting, heating, rolling, cooling and tempering.

In the above process of manufacturing a high-strength steel plate, a slab is heated to a temperature of 1040-1250° C. in the heating step.

During heating, austenization, growth of austenite grains, dissolution of carbonitrides and other processes occur in the steel plate. If the heating temperature is too low, the austenite grains will be refined, but the carbonitrides will not dissolve fully. Consequently, alloying elements Nb, Mo, etc. will not fulfil the corresponding effects during rolling and cooling. If the heating temperature is too high, the austenite grains will be coarsened, and the carbonitrides will dissolve fully but may cause abnormal growth of the austenite grains. With the growth of the austenization grains and the dissolution of the carbonitrides during heating taken into account comprehensively, the slab is heated to 1040-1250° C. in the invention.

In the above process of manufacturing a high-strength steel plate, the rolling step is divided into two stages, wherein the initial rolling temperature in the first stage is 1010-1240° C. Multi-pass rolling is conducted in the first stage, and the deforming rate of each pass is in the range of 8-30%. The second stage has an initial rolling temperature of 750-870° C., and a final rolling temperature of 740-850° C. Multi-pass rolling is conducted in the second stage, and the deforming rate of each passes is in the range of 5-30%.

The steel plate coining from the furnace is subjected to the first stage rolling. To ensure sufficient deformation of the steel plate, recrystallization of austenite, and refinement of austenite grains in the first stage, the rolling temperature and the deforming rate at each pass in the first stage must meet the requirements of the manufacturing process of the invention. After the first-stage rolling, the steel needs to be cooled to 750-870° C. before the second-stage rolling. In the second stage of rolling, a lot of dislocations are accumulated in austenite, which facilitates formation of refined microstructures in the subsequent cooling process, thereby increasing the strength and toughness of the steel plate.

In the above process of manufacturing a high-strength steel plate, in the cooling step, the rolled steel plate is water cooled to ≤450° C. at a rate of 15-50° C./s, followed by air cooling to room temperature.

During cooling, since a lot of dislocations are accumulated in the steel plate after the twice rolling, the rolled steel plate must be cooled at a rapid rate in order to guarantee that the steel plate should have a relatively large degree of undercooling. According to the invention, by using a rapid cooling rate and a low cooling stop temperature, microstructures resulting from low-temperature phase transition—ultrafine bainite lath and martensite—are formed in the steel plate. These microstructures have good strength and toughness. Therefore, the cooling stop temperature of the steel plate in the invention is set to be not more than 450° C., the cooling rate is 15-50° C./s, and the cooling is water cooling.

In the above process of manufacturing a high-strength steel plate, the tempering temperature is 450-650° C. in the tempering step.

In the course of tempering, high-strength microstructures comprising refined bainite and martensite are formed in the high-strength steel plate after rolling and cooling. If the tempering temperature is too high, tempering softening will be resulted and the strength of the steel plate will be decreased. If the tempering temperature is too low, the internal stress in the steel plate will become large, and fine, dispersed precipitates will not form. As a result, the low-temperature impact toughness of the steel plate will be decreased. A relatively large phase transition stress exists within high-strength structures. In order to eliminate the phase transition stress so as to obtain a steel plate having homogeneous and stable mechanical properties, the tempering temperature is controlled in the range of 450-650° C. in the manufacturing process of the invention.

Furthermore, the process of manufacturing a high-strength steel plate according to the invention further comprises a step of air cooling after the tempering.

In the technical solution of the present application, the compositional design with respect to some chemical elements and the manufacturing process may produce correlated effects, wherein optimized batching of alloying element Cr with other elements may guarantee the strength of the steel plate and avoid influence of an excessively high carbon equivalent value on the weldability of the steel plate after the above stated rolling and cooling procedures. In addition, due to the low carbon content in combination with the optimized Mn and Mo contents in the present invention, microstructures of refined bainite and martensite may be obtained when rolling is performed at a controlled low temperature and the steel plate is cooled to 450° C. or lower at a rapid cooling rate, and thus the strength and toughness of the steel plate is increased. Additionally, suitable control over alloying element B enables the steel plate to obtain microstructures having a mechanical property of high strength and toughness in a wide range of cooling rate.

Because of the use of reasonable compositional design and a low carbon equivalent value in combination with optimized heating, rolling, cooling and tempering processes according to the invention, the inventive high-strength steel plate has the following advantages over the prior art:

1) It comprises high-strength microstructures of ultrafine bainite lath and martensite;
2) It has a yield strength of equal to or more than 890 MPa;
3) It has excellent weldability, superior low-temperature toughness and good elongation;
4) It comprises less alloying elements and has a low carbon equivalent value CEV≤0.56%, so that the production cost is reduced; and
5) It meets the requirement of high strength and toughness in the field of mechanical equipments.

At the same time, according to the inventive process of manufacturing a high-strength steel plate, a technique of controlled rolling and controlled cooling is used in combination with reasonable compositional design and modified manufacturing steps to provide the steel plate with high-strength microstructures and good weldability, without any additional thermal conditioning treatment. Hence, the manufacturing procedure is simplified, and the manufacturing process may be fulfilled easily. The manufacturing process may be applied widely to constant production of steel plates having medium to large thickness.

DESCRIPTION OF DRAWING

FIG. 1 shows the optical microscopic microstructure of the high-strength steel plate obtained in Example 4.

DETAILED DESCRIPTION OF THE INVENTION

The technical solution of the invention will be further demonstrated with reference to the following specific examples and the accompanying drawing of the specification.

Examples 1-6

The high-strength steel plate of the invention was manufactured with the following steps:

1) Smelting: the batching of the various components was controlled as listed in Table 1, and the carbon equivalent value CEV≤0.56% was satisfied;
2) Casting;
3) Heating: the heating temperature was 1040-1250° C.;
4) Rolling: Rolling was divided into two stages, wherein the initial rolling temperature in the first stage was 1010-1240° C. Multi-pass rolling was conducted in the first stage, and the deforming rate of each rolling pass was in the range of 8-30%. After the first stage rolling, the steel plate was cooled, and the cooling may be conducted by air cooling with the steel plate being placed on the rolling rail, water or fog cooling from a spray device, or a combination thereof. The second stage comprises an initial rolling temperature of 750-870° C., and a final rolling temperature of 740-850° C. The second stage is a multi-pass rolling, and the deforming rate of each rolling pass was in the range of 5-30%;
5) Cooling: The rolled steel plate was water cooled to ≤450° C. at a rate of 15-50° C./s, and then air cooled to room temperature after coming out from water. The microstructures of the resulting steel plate were ultrafine bainite lath and martensite; and
6) Tempering: The tempering temperature was 450-650° C. After tempering, the steel plate was air cooled by means of piling cooling or bed cooling.

FIG. 1 shows the optical microscopic graph of the microstructure of the high-strength steel plate obtained in Example 4.

TABLE 1

Batching of the various components of the high-strength steel plates of Examples 1-6 in mass percentages (wt %, and the balance being Fe and unavoidable impurities)

| Examples | C | Si | Mn | Cr | Mo | Nb | V | Ti | Al | B | N | O | Ca | CEV |
|---|---|---|---|---|---|---|---|---|---|---|---|---|---|---|
| 1 | 0.115 | 0.3 | 1.8 | 0.2 | 0.4 | 0.05 | 0.05 | 0.04 | 0.08 | 0.002 | 0.005 | 0.003 | 0.003 | 0.545 |
| 2 | 0.105 | 0.35 | 1.9 | 0.25 | 0.3 | 0.04 | 0.04 | 0.03 | 0.07 | 0.0015 | 0.004 | 0.004 | 0.004 | 0.540 |
| 3 | 0.1 | 0.25 | 2 | 0 | 0.4 | 0.04 | 0.04 | 0.015 | 0.05 | 0.001 | 0.006 | 0.003 | 0.002 | 0.521 |
| 4 | 0.09 | 0.5 | 2.1 | 0.15 | 0.2 | 0.05 | 0.04 | 0.01 | 0.06 | 0.001 | 0.003 | 0.002 | 0.002 | 0.518 |
| 5 | 0.08 | 0.2 | 2.2 | 0.35 | 0.1 | 0.03 | 0.03 | 0.008 | 0.01 | 0.0006 | 0.002 | 0.003 | 0.001 | 0.543 |
| 6 | 0.07 | 0.4 | 2.3 | 0.05 | 0.4 | 0.06 | 0.06 | 0.002 | 0.03 | 0.0015 | 0.003 | 0.004 | 0 | 0.555 |

Table 2 shows the specific process parameters in Examples 1-6, wherein the specific process parameters of the various Examples in Table 2 correspond to the respective Examples 1-6 in Table 1.

TABLE 2

Specific process parameters in the manufacturing process of Examples 1-6

| Examples | Heating temperature (° C.) | Initial rolling temperature of the first stage | Deformation rate of each pass in the first stage (%) | Initial rolling temperature of the second stage(° C.) | Second stage final rolling temperature (°C) | Deformation rate of each pass in the second stage (%) | Cooling rate (° C./s) | Final cooling temperature (° C.) | Tempering temperature (° C.) |
|---|---|---|---|---|---|---|---|---|---|
| 1 | 1250 | 1240 | 15-30 | 870 | 850 | 10-30 | 45 | 450 | 500 |
| 2 | 1200 | 1170 | 8-30 | 840 | 810 | 5-25 | 20 | 200 | 650 |
| 3 | 1150 | 1120 | 8-25 | 810 | 800 | 5-30 | 30 | 400 | 600 |
| 4 | 1100 | 1080 | 15-28 | 790 | 780 | 15-25 | 50 | 350 | 550 |
| 5 | 1080 | 1050 | 10-25 | 770 | 760 | 15-30 | 15 | 300 | 450 |
| 6 | 1040 | 1010 | 10-28 | 750 | 740 | 10-28 | 15 | Room temperature | 650 |

TABLE 3

Relevant performance parameters of the high-strength steel plates in Examples 1-6 of the present technical solution

| Examples | Yield strength (MPa) | Tensile strength (MPa) | Elongation (%) | Longitudinal impact work at −40° C. Akv (J) | Pcm | Qm |
|---|---|---|---|---|---|---|
| 1 | 960 | 1070 | 13 | 112/121/103 | 0.266 | 3.70 |
| 2 | 945 | 1035 | 14 | 101/131/105 | 0.256 | 3.61 |
| 3 | 1040 | 1115 | 12 | 99/91/92 | 0.244 | 3.64 |
| 4 | 1010 | 1100 | 12 | 97/93/86 | 0.242 | 3.52 |
| 5 | 1005 | 1080 | 13 | 121/98/105 | 0.227 | 3.49 |
| 6 | 955 | 1050 | 13 | 105/111/96 | 0.241 | 4.11 |

* Note:

Pcm refers to welding crack sensitivity index, which meets formula Pcm = C + Si/30 + (Mn + Cr + Cu)/20 + Ni/60 + Mo/15 + V/10 + 5B.

Qm refers to hardenability coefficient of a steel plate, which meets formula Qm = 1.379C + 0.218Si + 1.253Mn + 2.113Mo + 0.879Cr + 101.21B.

As shown in Table 3 and Table 1, the high-strength steel plate of the invention has a low carbon equivalent value and a low welding crack sensitivity index, wherein CEV<0.56%, Pcm<0.27%, and hardenability coefficient 3.4<Qm<4.2. A low carbon equivalent value CEV and a low welding crack sensitivity index Pcm are favorable for a steel plate to obtain good weldability. As also shown in FIG. 3, the high-strength steel plate has a yield strength >900 MPa, a tensile strength >1000 MPa, an elongation ≥12%, an impact work Akv (−40° C.)>80 J. Therefore, the steel plate has good weldability and superior mechanical properties, can meet the requirements of a steel plate used in mechanical structures for high strength, low-temperature toughness and good weldability, and may be used widely for manufacturing structural members for engineering machinery, mining machinery and harbor machinery.

An average skilled person in the art would recognize that the above examples are only intended to illustrate the invention without limiting the invention in any way, and all changes and modifications to the above examples will fall in the scope of the claims of the invention so long as they are within the scope of the substantive spirit of the invention.

What is claimed is:

1. A high-strength hot-rolled steel plate, consisting of the following chemical elements in mass percentages:

C: from 0.080% to 0.115%,

Si: from 0.20% to 0.50%,

Mn: 1.80-2.30%,

Cr: 0-0.35%,

Mo: equal to or larger than 0.10% and less than 0.20%,

Nb: equal to or larger than 0.03% and equal to or less than 0.06%,

V: 0.03-0.06%,

Ti: 0.002-0.04%,

Al: 0.01-0.06%,

B: 0.0006-0.0020%,

N≤0.0060%,

O≤0.0040%,

Ca: equal to or larger than 0% and equal to or less than 0.0045%, and the balance of Fe and unavoidable impurities, wherein the high-strength steel plate has a yield strength of 890 MPa or higher, a tensile strength >than 1000 MPa, an elongation ≥12%, an impact work Akv at −40° C. of larger than 80 J;

wherein the high-strength steel plate's microstructures are bainite lath and martensite; and wherein the high-strength steel plate has a carbon equivalent value CEV≤0.56% and a welding crack sensitivity index Pcm≤0.27%.

2. A process of manufacturing the high-strength steel plate of claim 1, comprising the following steps in sequence: smelting, casting, heating, rolling, cooling and tempering.

3. The process of manufacturing the high-strength steel plate according to claim 2, wherein a slab is heated to 1040-1250° C. in the heating step.

4. The process of manufacturing the high-strength steel plate according to claim 2, wherein the rolling step is divided into two stages, the initial rolling temperature in the first stage is 1010-1240° C., multi-pass rolling is conducted in the first stage, and the deforming rate of each pass is in the range of 8-30%; wherein the second stage has an initial rolling temperature of 750-870° C. and a final rolling temperature of 740-850° C., multi-pass rolling is conducted in the second stage, and the deforming rate of each pass is in the range of 5-30%.

5. The process of manufacturing the high-strength steel plate according to claim 2, wherein after the rolling step, the rolled steel plate is water cooled to ≤450° C. at a rate of 15-50° C./s and then air cooled to room temperature in the cooling step.

6. The process of manufacturing the high-strength steel plate according to claim 2, wherein the tempering temperature is 450-650° C. in the tempering step.

7. The process of manufacturing the high-strength steel plate according to claim 2, wherein air cooling is conducted after the tempering.

* * * * *